US007036858B2

(12) United States Patent
Buck

(10) Patent No.: US 7,036,858 B2
(45) Date of Patent: May 2, 2006

(54) HOIST RING

(76) Inventor: James R. Buck, 1212 SW. 20th St., Cape Coral, FL (US) 33991

( * ) Notice: Subject to any disclaimer, the term of this patent is extended or adjusted under 35 U.S.C. 154(b) by 331 days.

(21) Appl. No.: 10/621,050

(22) Filed: Jul. 16, 2003

(65) Prior Publication Data

US 2005/0012346 A1 Jan. 20, 2005

(51) Int. Cl.
*B66C 1/10* (2006.01)

(52) U.S. Cl. ..... 294/1.1; 294/82.1; 403/78

(58) Field of Classification Search ..... 294/1.1, 294/82.1, 89; 403/78, 79, 164; 410/101
See application file for complete search history.

(56) References Cited

U.S. PATENT DOCUMENTS 1,321,356 A 11/1919 Bateman
3,163,901 A 1/1965 Brawand
4,429,526 A * 2/1984 Rehbein ..... 59/93
4,641,986 A 2/1987 Tsui et al.
4,705,422 A * 11/1987 Tsui et al. ..... 403/60
5,248,176 A * 9/1993 Fredriksson ..... 294/1.1
5,352,056 A 10/1994 Chandler
5,405,210 A 4/1995 Tsui
5,848,815 A * 12/1998 Tsui et al. ..... 294/1.1
6,199,925 B1 * 3/2001 Alba ..... 294/1.1
6,293,600 B1 * 9/2001 Lecourt ..... 294/1.1

* cited by examiner

*Primary Examiner*—Dean J. Kramer
(74) *Attorney, Agent, or Firm*—Flynn, Thiel, Boutell & Tanis, P.C.

(57) ABSTRACT

A hoist ring assembly includes an annular body, a first axial bore generally concentric with a longitudinal axis and including diametrically opposed first and second sockets. A mounting assembly is provided for facilitating the mounting of the annular body onto an object. A U-shaped hoist ring member is provided and has remote ends formed into integral stub shaft members, the stub shaft members extending generally coaxially with and spaced from one another to define a co-axis therebetween. The stub shaft members are relatively rotatably received in the sockets. The peripheral surface of the stub shaft members each has an annular groove therein located within the socket. A radially inwardly extending member in each socket is received in each of the grooves to prevent the legs of the hoist ring member from spreading apart as well as removal of the stub shaft members from the sockets while maintaining the ability of the hoist ring to pivot about the aforesaid co-axis.

8 Claims, 2 Drawing Sheets

10
46
36
16
P1
26
28
53
20
56
11
P3
X
32

10
46
36
29
11
34
16
13
26
32
47
31
49
12
41
P4
33
39
52
51
37
38
3
18
17
27
14
48
50
P4

52
17
22
21
19
P2
18
27
54

HOIST RING

FIELD OF THE INVENTION

This invention relates to a hoist ring assembly and, more particularly, to a hoist ring assembly which is composed of easily manufactured components which are subject to easy assembly.

BACKGROUND OF THE INVENTION

Hoist rings are widely known in industry to facilitate the placement of attachment locations on heavy objects so that cranes and the like may be connected to the attachment locations to lift and move the objects from one location to a second location. U.S. Pat. Nos. 5,352,056 and 5,405,210 are representative examples of known hoist ring assemblies.

SUMMARY OF THE INVENTION

A preferred embodiment of the hoist ring assembly according to the present invention includes an annular body having first and second ends and diametrically opposed first and second coaxial sockets, each of the sockets having a radially inwardly projecting segment. A U-shaped hoist ring member is provided having remote ends formed into integral stub shaft members, the stub shaft members extending generally coaxially and are spaced from one another to define a co-axis therebetween. The stub shaft members are relatively rotatably received in a respective one of the first and second sockets in the annular body. Each of the stub shaft members has an annular groove therein oriented in a theoretical plane extending perpendicular to the annular grooves each received therein a respective radially inwardly projecting member. A securement mechanism is provided for securing the annular body to an object.

BRIEF DESCRIPTION OF THE DRAWINGS

Referring particularly to the drawings for purposes of illustration and not limitation.

DETAILED DESCRIPTION

Figure 2:
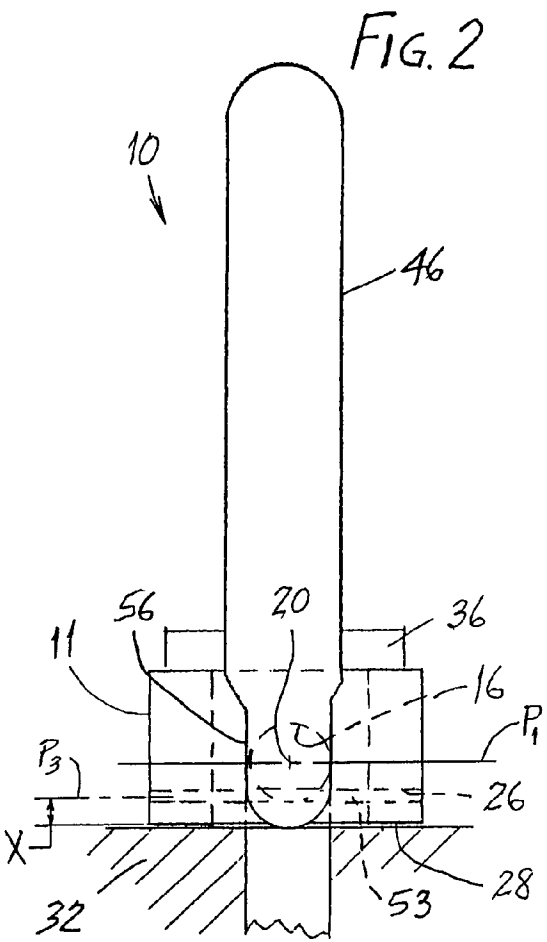
FIG. 2 is a side view of the configuration illustrated in FIG. 1.
Figure 1:
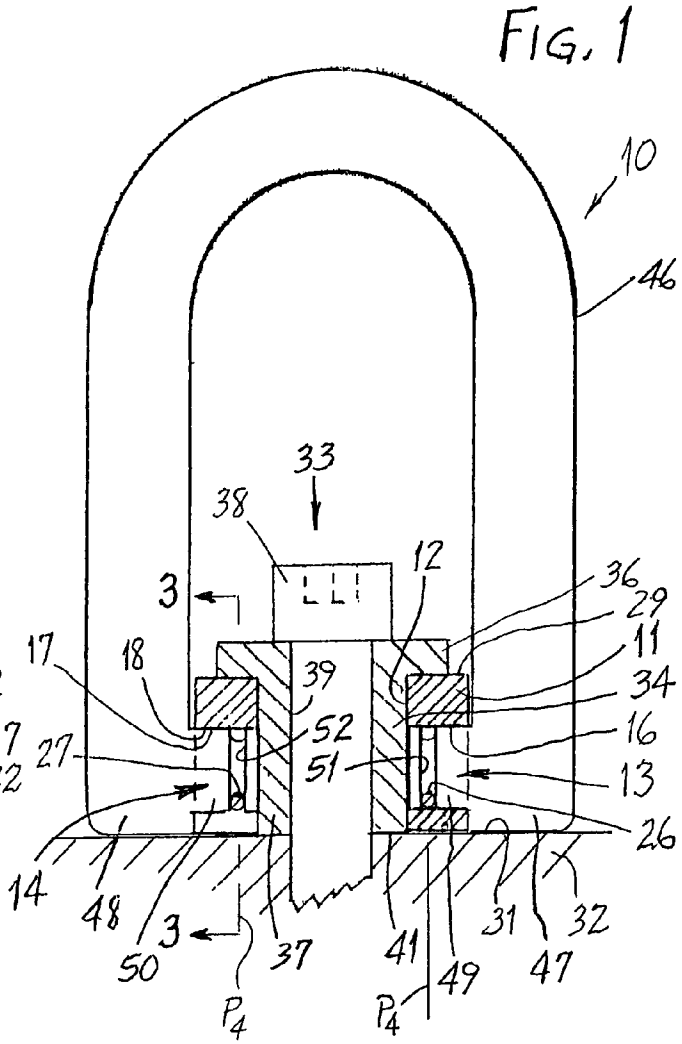
FIG. 1 is a partially sectioned side elevational view of a first embodiment of a hoist ring assembly embodying the invention.
Figure 3:
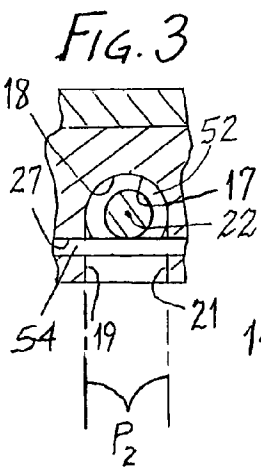
FIG. 3 is a sectional view taken along the line 3—3 of FIG. 1.

FIGS. 1 and 2 both illustrate a first embodiment of a hoist ring assembly 10 embodying the invention. The hoist ring assembly 10 includes a unitary annular body 11 having a centrally disposed axial bore 12 extending therethrough. Diametrically opposed sockets 13 and 14 are provided in the outer peripheral surface of the annular body 11. In this particular embodiment, the socket 13 is defined by a hole 16 which is circular in cross section and extends between and opens outwardly at an outer surface of the annular body 11 and inwardly into the axial bore 12. An axis of the hole 16 is contained in a theoretical first plane $P_1$ that is oriented perpendicular to an axis of the axial bore 12.

The socket 14 is defined by a second hole 17 having a first part 18 that is semicircular in cross section and a second part that includes opposed parallel walls 19 and 21 that are each contained in a theoretical plane $P_2$ that is oriented perpendicular to the plane $P_1$. The axis 22 of the first part 18 of the hole 17 is oriented in the plane $P_1$ and is coaxial with the axis of the circular hole 16. The planes $P_2$ are furthermore parallel to the axes 20 and 22 of the holes 16 and 17, respectively. The hole 17 extends between and opens outwardly at the outer surface of the annular body 11 and inwardly into the axial bore 12.

Pilot holes 26 and 27 are provided in the annular body 11 and intersect with the respective sockets 13 and 14, respectively, and extend along respective parallel axes that are oriented in a common plane $P_3$ extending perpendicular to the axis of the axial bore 12. The plane $P_3$ is oriented a finite distance X from one end surface 28 of the annular body 11. The axis of the pilot hole 26 intersects on a chord of a wall surface of the circular socket 13 and the axis of the pilot hole 27 intersects the opposing parallel walls 19 and 21 of the socket 14.

A U-shaped hoist ring member 46 is provided and has remote ends 47 and 48 formed into integral stub shaft members 49 and 50, respectively. The stub shaft members 49 and 50 extend generally coaxially with and are spaced from one another so as to define a co-axis coaxial with the axes 20, 22. The stub shaft members 49 and 50 are relatively rotatably received in a respective one of the sockets 13 and 14. Each stub shaft member 49 and 50 includes an annular groove 51 and 52, respectively, therein oriented in planes $P_4$ containing the axis of a respective pilot hole 26 and 27.

To assemble the hoist ring member 46 to the annular body 11, the hoist ring member 46 is rotated 180° from the position illustrated in FIG. 1 so that a reduced thickness region 56 on one of the legs of the U (both legs have the aforesaid region of reduced thickness whose thickness is slightly less than the spacing between the walls 19 and 21) becomes aligned with the socket 14 and between the walls 19 and 21 to enable the ring to be shifted first rightwardly to enable the axis of the stub shaft member 49 to be aligned with the axis of the socket 13 and then subsequently shifted leftwardly to enable the stub shaft member 49 to enter the socket 13 and enable the hoist ring member 46 to be returned to the position illustrated in FIG. 1. Thereafter, a pin 53 can be inserted into the pilot hole 26 and a pin 54 inserted into the pilot hole 37. The pins will enter a fragment of each of the grooves 51 and 52 to prevent disassembly or pulling out of the stub shafts from the interior of the annular body 11.

The annular body 11 is secured to a surface 31 of an object 32 by a fastener assembly 33. More specifically, the fastener assembly 33 includes an annular bushing body 34 having a radially outwardly extending flange 36 at the upper end thereof. The bushing body 34 is sized to be snugly slidably received into the axial bore 12 and to support the annular body 11 for rotation about the axis of the axial bore 12. The shank 37 of the bushing body 34 extends a length longer than is the axial thickness of the annular body 11 so that, when assembled, the underside of the flange 36 will be oriented immediately adjacent the top end surface 29 of the annular body 11. The diameter of the flange 36 is greater than the diameter of the axial bore 12. A screw (or bolt) 38 is received in the centrally disposed axial bore 39 in the bushing body 34 with the threaded part of the screw 38 being received into the material of the object 32. Since the length of the shank 37 of the bushing body 34 is greater than the thickness of the annular body 11, and since the lower end surface 41 of the bushing body 34 rests on the surface 31 of the object 32, sufficient clearance will be provided between the undersurface of the flange 36 and the surface 31 of the object 32 to facilitate a relative rotative movement of the annular body about the axis of the axial bore 12.

Figure 5:
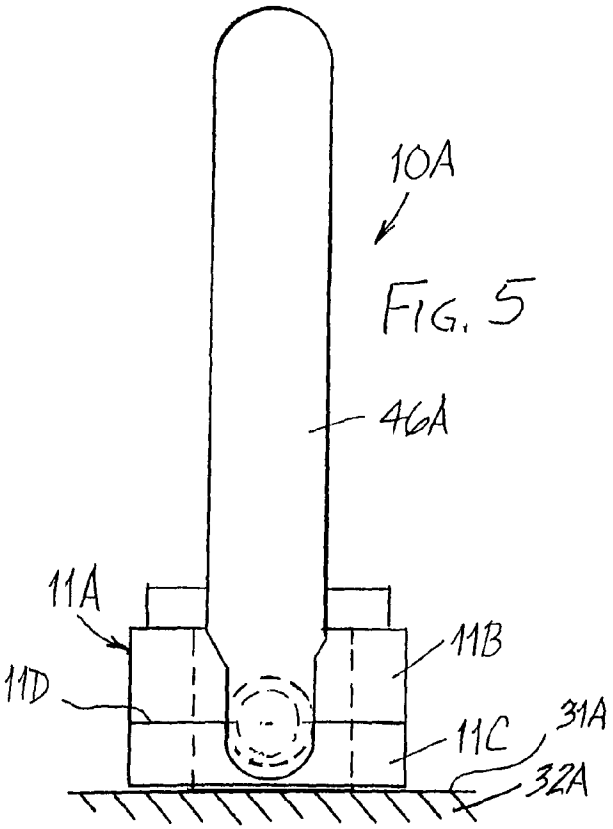
FIG. 5 is a side view of the configuration illustrated in FIG. 4.
Figure 4:
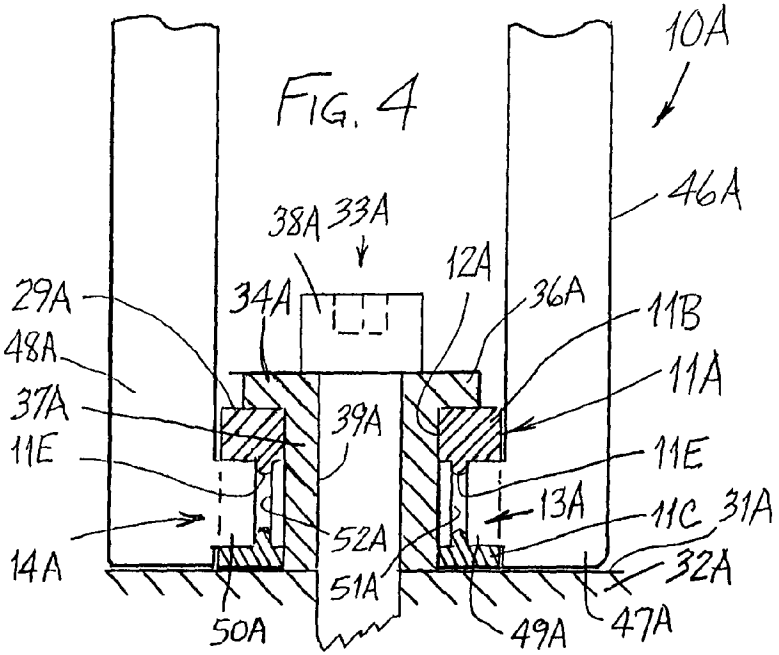
FIG. 4 is a partially sectioned side elevational view of a second embodiment of a hoist ring assembly embodying the invention.
Figure 6:
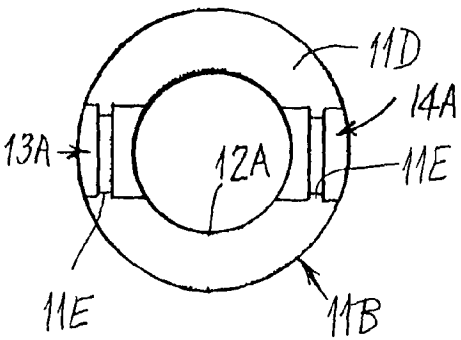
FIG. 6 is a view of an axially facing end of one piece of a two piece annular body construction.
Figure 7:
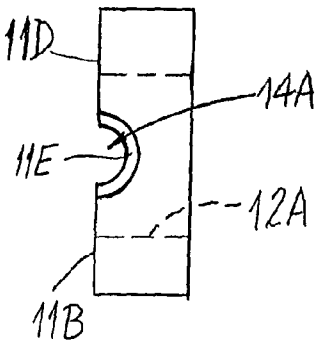
FIG. 7 is a side view of FIG. 6.

FIGS. 4–7 illustrate a second embodiment of a hoist ring assembly 10A embodying the invention. The hoist ring assembly 10A includes an annular body 11A composed of two pieces 11B and 1C. It will be assumed for purposes of this disclosure that the two pieces 11B and 11C are identical to each other even though FIGS. 4 and 5 illustrate the pieces to have differing thicknesses. The annular body piece 11B has a centrally disposed axial bore 12A extending therethrough. Diametrically opposed semicircular-shaped sockets 13A and 14A are provided in the outer peripheral surface of the body piece 11B. In this particular embodiment, the sockets 13 and 14 are both defined by a semicircular cut that extends between and opens outwardly at an outer surface of the annular body piece 11B and inwardly into the axial bore 12A. The axes of the semicircular-shaped sockets 13A and 14A are coaxial. Each piece of the annular body 11 includes a flat surface 11D so that when the surface 11D on each piece is oriented to oppose each other and brought into engagement with each other, the semicircular-shaped sockets 13A and 14A will form a circular-shaped hole. Each socket has a radially inwardly projecting bead 11E.

A U-shaped hoist ring member 46A is provided and has remote ends 47A and 48A formed into integral stub shaft members 49A and 50A, respectively. The stub shaft members 49A and 50A extend generally coaxially with and are spaced from one another so as to define a co-axis coaxial with the axes of the sockets 13A and 14A. The stub shaft members 48A and 50A are relatively rotatably received in a respective one of the two sockets 13A and 14A formed by the joined together two pieces 11B and 11C of the annular body 11A. Each stub shaft member 49A and 50A includes an annular groove 51A and 52A, respectively, therein and are configured to receive the radially inwardly projecting bead 11E in each of the two sockets 13A and 14A formed by the two pieces 11B and 11C of the annular body 11A.

To assemble the hoist ring member 46A illustrated in FIG. 4 to the annular body 11A, the hoist ring member 46A is oriented relative to one of the pieces 11B of the annular body 11A so that a stub shaft member 49A and 50A are received into a respective half socket 13A and 14A. Thereafter, the second piece 11C is oriented so that the face 11D thereof mates with the face 11D of the other piece 11B and so that the sockets 13A and 14A receive the other half of the stub shaft members 49A and 50A. Thereafter, the annular body 11A is secured to a surface 31A of an object 32A by a fastener assembly 33A. The fastener assembly 33A includes an annular bushing body 34A having a radially outwardly extending flange 36A at the upper end thereof. The bushing body 34A is sized to be snugly slidably received into the axial bores 12A in each piece 11B and 11C of the annular body 11A and to support the annular body 11A for rotation about the axis of the axial bores 12A. The shank 37A of the bushing body 34A extends a length longer than is the axial thickness of the two pieces of the annular body 11A so that, when assembled, the underside of the flange 36A will be oriented immediately adjacent the top end surface 29A of the upper piece 11B of the annular body 11A. The diameter of the flange 36A is greater than the diameter of the axial bores 12A. A screw (or bolt) 38A is received in the centrally disposed axial bore 39A in the bushing body 34A with the threaded part of the screw 38A being received into the material of the object 32A. The radially inwardly projecting beads 11E on each annular body piece 11B and 11C received in the respective annular grooves 52A will prevent the legs of the hoist ring member 46A from spreading apart.

It is to be considered within the scope of this invention that the bushings 34 and 34A can be assembled upside down to that illustrated in the drawings so that the flanges 36 and 36A rest on the surface of the objects 32 and 32A. In this instance, a not illustrated washer would be provided between the head of the screws 38 and 38A and the material of the bushings 34 and 34A.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. A hoist ring assembly, comprising:

an annular body having first and second ends and diametrically opposed first and second coaxial sockets, said annular body being composed of two separate pieces, each piece having identical opposing faces comprised of one half of each of said first and second sockets therein, said sockets opening outwardly at a surface on each thereof and are configured so that when said surface on said separate pieces oppose and engage one another, said first and second sockets will become defined, each of said sockets having a radially inwardly projecting member of finite width;

a U-shaped hoist ring member having remote ends formed into integral stub shaft members, said stub shaft members extending generally coaxially and spaced from one another to define a co-axis therebetween, said stub shaft members being relatively rotatably received in a respective one of said first and second sockets in said annular body, each of said stub shaft members having an annular groove therein of a finite width conforming to said finite width of said radially inwardly projecting member, said annular groove being oriented in theoretical planes extending perpendicular to said co-axis, said annular grooves each being configured to receive therein a respective said radially inwardly projecting member; and a securement mechanism for securing said annular body to an object.

2. The hoist ring assembly according to claim 1, wherein said radially inwardly projecting member is an arcuate bead segment on at least one of said separate pieces conforming in size and shape to a size and shape of said annular groove in each said stub shaft member.

3. The hoist ring assembly according to claim 2, wherein a said arcuate bead segment is provided in each half socket on each separate piece.

4. The hoist ring assembly according to claim 1, wherein said separate pieces are identical to one another.

5. A hoist ring assembly, comprising:

an annular body having first and second ends and diametrically opposed first and second sockets, said first socket being defined by a first hole circular in cross section extending between and opening outwardly at an outer surface of said annular body and inwardly a first finite distance into said annular body, an axis of said first hole being contained in a theoretical first plane that is oriented perpendicular of a central axis of said annular body, said second socket being defined by a second hole having a first part that is semicircular in cross section and a second part that includes opposed parallel walls that are spaced from one another a second finite distance and are each contained in theoretical second planes that are oriented perpendicular to said first plane, an axis of said first part of said second hole being oriented in said first plane and coaxial with said axis of said first hole, said second planes further being parallel to said axis of said first part of said second hole, said second hole extending between and opening outwardly at said outer surface of said annular body and inwardly a third finite distance into said annular body;

first and second pilot holes extending into said annular body and along respective parallel axes that are oriented in a common third plane extending perpendicular to said axis of said first axial bore, said third plane being oriented a finite distance from one of said first and second ends of said annular body and intersecting on a chord of a wall surface of said first socket and said opposing parallel walls of said second socket;

a U-shaped hoist ring member having remote ends formed into integral stub shaft members, said stub shaft members extending generally coaxially with and spaced from one another to define a coaxis therebetween, said stub shaft members being relatively rotatably received in a respective one of said first and second holes in said annular body, each of said stub shaft members having an annular groove therein oriented in theoretical fourth planes containing an axis of a respective pilot hole;

a pin received in each pilot hole and a fragment of each groove to prevent removal of said stub shaft members from said first and second holes in said annular body; and a securement mechanism for securing said annular body to an object.

6. The hoist ring assembly according to claim 5, wherein at least one of said remote ends of said U-shaped ring member has a thickness slightly less than said second finite distance between said opposed parallel walls to facilitate assembly of said U-shaped ring member to said annular body.

7. A hoist ring assembly, comprising:

an annular body having first and second ends, a first axial bore generally concentric with a longitudinal axis and including diametrically opposed first and second sockets, said first socket being defined by a first hole circular in cross section extending between and opening outwardly at an outer surface of said annular body and inwardly into said axial bore, an axis of said first hole being contained in a theoretical first plane that is oriented perpendicular of an axis of said first axial bore, said second socket being defined by a second hole having a first part that is semicircular in cross section and a second part that includes opposed parallel walls that are each contained in theoretical second planes that are oriented perpendicular to said first plane, an axis of said first part of said second hole being oriented in said first plane and coaxial with said axis of said first hole, said second planes further being parallel to said axis of said first part of said second hole, said second hole extending between and opening outwardly at said outer surface of said annular body and inwardly into said first axial bore;

first and second pilot holes extending into said annular body and along respective parallel axes that are oriented in a common third plane extending perpendicular to said axis of said first axial bore, said third plane being oriented a finite distance from one of said first and second ends of said annular body and intersecting on a chord of a wall surface of said first socket and said opposing parallel walls of said second socket;

an annular bushing body received in said axial bore, said bushing body having a second axial bore generally concentric with a longitudinal axis thereof and a radially outwardly extending flange at one end larger in diameter than said first axial bore, said bushing body between a surface on said flange configured to oppose one of said first and second ends of said first annular body and an end of said bushing body remote from said surface on said flange having a length greater than an axial length of said annular body;

a screw received in said second axial bore;

a U-shaped hoist ring member having remote ends formed into integral stub shaft members, said stub shaft members extending generally coaxially with and spaced from one another to define a coaxis therebetween, said stub shaft members being relatively rotatably received in a respective one of said first and second holes in said annular body, each of said stub shaft members having an annular groove therein oriented in theoretical fourth planes containing an axis of a respective pilot hole;

a pin received in each pilot hole and a fragment of each groove to prevent removal of said stub shaft members from said first and second holes in said annular body.

8. The hoist ring assembly according to claim 7, wherein at least one of said remote ends of said U-shaped ring member has a thickness slightly less than said second finite distance between said opposed parallel walls to facilitate assembly of said U-shaped ring member to said annular body.

* * * * *